US010054113B2

(12) United States Patent
Weihing et al.

(10) Patent No.: US 10,054,113 B2
(45) **Date of Patent: *Aug. 21, 2018**

(54) ADJUSTMENT DEVICE FOR A HYDROSTATIC PISTON MACHINE, AND HYDROSTATIC AXIAL PISTON MACHINE

(71) Applicant: Robert Bosch GmbH, Stuttgart (DE)

(72) Inventors: Benjamin Weihing, Haiterbach (DE); Andreas Apperger, Eutingen (DE); Ruslan Rudik, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 494 days.

This patent is subject to a terminal disclaimer.

(21) Appl. No.: 14/719,676

(22) Filed: May 22, 2015

(65) Prior Publication Data

US 2015/0337829 A1 Nov. 26, 2015

(30) Foreign Application Priority Data

May 22, 2014 (DE) ..... 10 2014 209 749
Apr. 22, 2015 (DE) ..... 10 2015 207 259

(51) Int. Cl.
*F15B 15/24* (2006.01)
*F04B 1/32* (2006.01)
(Continued)

(52) U.S. Cl.
CPC ..... *F04B 1/324* (2013.01); *F04B 1/2042* (2013.01); *F15B 9/09* (2013.01); *F15B 9/10* (2013.01)

(58) Field of Classification Search
CPC ..... F04B 1/324; F04B 1/2042; F15B 9/09; F15B 9/10
(Continued)

(56) References Cited

U.S. PATENT DOCUMENTS 4,379,389 A 4/1983 Liesener
4,381,646 A * 5/1983 Ruseff ..... F04B 49/08 417/222.1
(Continued)

FOREIGN PATENT DOCUMENTS

DE 40 20 325 C2 1/1995
DE 100 01 826 C1 9/2001
(Continued)

*Primary Examiner* — Charles Freay
(74) *Attorney, Agent, or Firm* — Maginot, Moore & Beck LLP

(57) ABSTRACT

An adjustment device for regulating the torque of a hydrostatic piston machine with adjustable swept volume, comprises an adjustment piston delimiting an adjustment chamber, a regulation valve defining a valve bore and including a valve slide positioned in the valve bore that controls inflow and outflow of pressure medium, and first and second feedback springs configured to exert feedback force on the valve slide in first and second displacement directions dependent on a position of the adjustment piston. The device further includes a regulation spring configured to exert a force on the valve slide in a second displacement direction. During an adjustment of the adjustment piston in a direction of maximum swept volume of the piston machine, beyond a particular position of the adjustment piston, the first and second feedback springs exert an increased force on the valve slide determined only by a spring constant of the first feedback spring.

18 Claims, 7 Drawing Sheets

(51) Int. Cl.
*F15B 9/10* (2006.01)
*F15B 9/09* (2006.01)
*F04B 1/20* (2006.01)

(58) Field of Classification Search
USPC ..... 92/13
See application file for complete search history.

(56) References Cited

U.S. PATENT DOCUMENTS 4,723,892 A * 2/1988 Cowan ..... F04B 1/324
417/222.1
7,334,513 B2 * 2/2008 Belser ..... F04B 1/324
92/12.1

FOREIGN PATENT DOCUMENTS

EP 1 118 771 * 12/2000
WO WO 2014/156207 * 2/2014

* cited by examiner

ADJUSTMENT DEVICE FOR A HYDROSTATIC PISTON MACHINE, AND HYDROSTATIC AXIAL PISTON MACHINE

This application claims priority under 35 U.S.C. § 119 to patent application no. DE 10 2014 209 749.5, filed on May 22, 2014 in Germany, and patent application no. DE 10 2015 207 259.2, filed Apr. 22, 2015 in Germany, both of the disclosures of which are incorporated herein by reference in their respective entireties.

The disclosure relates to an adjustment device which is provided for a hydrostatic machine, in particular for a hydrostatic axial piston machine, and to a hydrostatic axial piston machine, in particular an axial piston pump, which is equipped with an adjustment device of said type.

BACKGROUND

For the regulation of hydrostatic piston machines, previous adjustment devices having an adjustment piston and having a regulation valve are known, by means of which it is achieved that a torque received or output by the piston machine does not exceed a particular value or value range. This type of regulation is referred to as torque regulation, or also as power regulation, wherein the latter designation disregards the fact that the power of a machine is in fact co-determined by the rotational speed thereof. The regulation valve is referred to as torque regulator or as power regulator. Power regulation arrangements exist in the case of which the product of the pressure at the pressure port of the piston machine and the swept volume is kept constant. Here, the swept volume is the pressure medium quantity that flows through the machine per rotation of the drive shaft. In the case of other types of power regulation, a hyperbolic characteristic curve between swept volume and pressure, on which curve the torque is constant, is approximated by straight lines. In the case of such torque regulation, the torque is kept only approximately constant, wherein the adjustment device can be made simpler and more compact than an adjustment device with regulation to a constant torque.

DE 40 20 325 C2 has disclosed an adjustment device for approximate regulation to a constant torque for an adjustable hydrostatic pump, wherein the valve slide of a regulation valve, also referred to as power regulator, is displaceable in a bushing that can be driven by the adjustment piston, and said valve slide is acted on in a first displacement direction by the pump pressure and in the opposite displacement direction by a spring pack composed of two springs which are braced between the valve slide and plate springs which are adjustable but which otherwise have an inherent fixed position. In addition to the regulation valve provided for the regulation of the torque, the known adjustment device also includes are a pressure regulation valve, also referred to as pressure regulator, and a delivery flow regulation valve, also referred to as delivery flow regulator. By means of each of said regulators, the inflow and outflow of control oil into the adjustment chamber and out of the adjustment chamber can be controlled at the adjustment piston. The special feature of the power regulation in this case is that the travel of the adjustment piston is fed back directly, as a travel, to the bushing of the power regulator.

U.S. Pat. No. 4,379,389 has disclosed an axial piston pump of swashplate type of construction, having a drive shaft, having a cylinder drum in which the displacement pistons are situated, having a swashplate, and having an adjustment device which, for power regulation. Here, the adjustment piston and the valve slide of the power regulator are arranged in alignment one behind the other. In the case of the axial piston pump known from U.S. Pat. No. 4,379,389, when the swept volume is at a maximum, the adjustment piston is deployed to the maximum extent, and the adjustment chamber at the adjustment piston has its largest volume. The valve slide is acted on by the pump pressure in a first displacement direction. In the event of an adjustment in said direction from the neutral position, control oil is discharged from the adjustment chamber and the adjustment piston retracts. Between the adjustment piston and the valve slide there are braced two feedback springs which are in the form of helical compression springs and of which a first feedback spring exerts a force on the valve slide over the entire travel of the adjustment piston, and the second feedback spring exerts a force on the valve slide only after a particular partial stroke of the adjustment piston proceeding from that position of the adjustment piston which corresponds to a maximum swept volume. In this way, a hyperbolic characteristic curve on which the torque is constant is approximated by two straight lines. In the case of an adjustment device according to U.S. Pat. No. 4,379,389, the travel of the adjustment piston is fed back, as a force, to the valve slide.

A previous hydrostatic axial piston machine having an adjustment device is also disclosed in DE 100 01 826 C1. Said swashplate-type axial piston machine, designed as an axial piston pump, has a drive unit with a multiplicity of displacement pistons which are guided in cylinder bores of a cylinder drum and which, together with said cylinder bores, delimit in each case one working chamber. The displacement pistons are supported via slide shoes on a swashplate, the angle of inclination of which is variable for the purposes of varying the swept volume. Owing to the pivoting capability, an adjustable swashplate is also referred to as pivot cradle. The adjustment is performed by way of an adjustment device which has an adjustment piston which engages indirectly or directly on the pivot cradle and pivots the latter out of a basic position into which the pivot cradle is preloaded by way of an opposing piston or a spring. In the basic position, the pivot cradle may for example be set to its maximum pivot angle, in which the swept volume is at a maximum. By contrast to the axial piston pump according to U.S. Pat. No. 4,379,389, the adjustment piston is fully retracted, and the adjustment chamber has its smallest volume, when the swept volume is at a maximum. Deployment of the adjustment piston causes the pivot cradle to be pivoted back toward smaller pivot angles and smaller swept volumes.

The adjustment piston delimits an adjustment chamber which is connectable by way of a regulation valve (so-called power regulator) to a line which conducts the pump pressure or to a tank. The regulation valve has a valve slide which has the same central axis as the adjustment piston and which is preloaded by way of two feedback springs into a basic position in which the adjustment chamber is connected to the tank. To now achieve that the adjustment piston is fully retracted in the basic position, which corresponds to maximum swept volume, the feedback springs are supported on a spring rod which extends through the valve slide and is connected to the adjustment piston. The valve slide is a stepped piston with a differential surface which is acted on with the pump pressure and is arranged such that the pump pressure generates, on the valve slide, a force which is directed counter to the force of the feedback springs.

In the known solution, the two feedback springs are helical springs which are arranged coaxially with respect to one another and of which one, proceeding from a fully retracted adjustment piston and minimum adjustment chamber, acts only after a particular partial stroke and thus proceeding from a particular position of the adjustment piston on the valve slide. This yields a p-Q characteristic curve (pressure-swept volume characteristic curve) composed of two straight lines, wherein the gradient of one straight line is defined by the spring constant of the spring that is initially in engagement, and the gradient of the further straight line is defined by the sum of the spring constants of the springs which, after the partial stroke, are jointly in engagement. By means of these two straight lines that are inclined relative to one another, the hyperbolic p-Q characteristic curve, on which the torque is constant, is obtained in approximated fashion. The characteristic curve made up of two straight lines has a bend in the delivery volume, which bend corresponds to the position of the adjustment piston at which the second feedback spring begins to act.

A disadvantage of the known solution is that, owing to the spring rod which extends through the regulating piston, the adjustment device is of highly complex construction and furthermore has a considerable structural length.

SUMMARY

By contrast, the disclosure is based on the object of providing an adjustment device and an axial piston machine equipped with an adjustment device of said type, with which power/torque regulation is made possible with reduced outlay in terms of apparatus.

Said object is achieved, with regard to the adjustment device and the axial piston machine of the present disclosure.

An adjustment device according to the disclosure for regulating the torque of a hydrostatic piston machine with adjustable swept volume has an adjustment piston which delimits an adjustment chamber, a regulation valve which has a first port, a second port and a third port, the latter being fluidically connected to the adjustment chamber, and which has a valve slide which, in a regulation position, separates the third port from the first port and from the second port and, outside the regulation position, fluidically connects the third port to the first port or to the second port, such that pressure medium flows into the adjustment chamber or out of the adjustment chamber. The valve slide has a measurement surface at which said valve slide can be acted on by the operating pressure of the piston machine in a first displacement direction. An adjustment device according to the disclosure furthermore has a first feedback spring and a second feedback spring which exert on the valve slide a feedback force which is dependent on the position of the adjustment piston. The feedback force exerted by the feedback springs is oriented in the first displacement direction, that is to say in the same displacement direction as the force generated by the operating pressure at the measurement surface of the valve slide. During an adjustment of the adjustment piston in the direction of maximum swept volume of the piston machine, beyond a particular position of the adjustment piston, the increase in the force exerted by the two feedback springs on the regulation piston is determined only by the spring constant of the first feedback spring. Furthermore, a regulation spring is provided which exerts on the valve slide a force in a second displacement direction opposite to the first displacement direction.

In the case of an adjustment device according to the disclosure, it is the case, as in the known adjustment devices, that the valve slide assumes its regulation position when the forces acting thereon are in equilibrium in the regulation position. Assuming that the pressure prevailing in the adjustment chamber does not exert a resultant force on the valve slide, it is thus the case that, in the regulation position, the sum of the spring force of the feedback springs and of the pressure force exerted by the operating pressure is equal to the spring force of the regulation spring plus any auxiliary force that acts with the regulation spring. A change in operating pressure leads to a displacement of the valve slide out of the regulation position. Pressure medium then flows to the adjustment chamber or out of the adjustment chamber, such that the adjustment piston is moved and the spring force exerted on the valve slide by the feedback springs changes. The valve slide returns into its regulation position and stops the pressure medium flow as soon as the adjustment piston has reached a position in which the change in operating pressure has been compensated by an opposing change in the spring force of the feedback springs, and the sum of the spring force of the feedback springs and of the pressure force is again equal to the spring force of the regulation spring plus any auxiliary force that acts with the regulation spring. Proceeding from a position of the adjustment piston which corresponds to a minimum swept volume, it is the case according to the disclosure that, during an adjustment of the adjustment piston in the direction of maximum swept volume, beyond a particular position of the adjustment piston, only the spring constant of the first feedback spring is determinative. This means that, between the particular position of the adjustment piston and that position of the adjustment piston which corresponds to the maximum swept volume, the pressure force decreases with a gradient of equal magnitude to the gradient of the increase of the spring force of the first feedback spring. In positions of the adjustment piston before the particular position, the increase in the spring force exerted by the feedback springs is determined by the spring constants of both feedback springs. In this case, the second feedback spring ensures that the gradient with which the spring force increases up to the particular position is steeper than that after the particular position. Correspondingly, the pressure force and thus the pressure decrease with a steeper gradient before the particular position of the adjustment piston than after the particular position. This thus yields the desired characteristic curve between the operating pressure and the swept volume, with a bend between two straight sections, wherein the bend is situated at the particular position of the adjustment piston. Here, it is also pointed out that, normally, the operating pressure is the variable, and the swept volume is adjusted correspondingly. The characteristic curve can thus also be characterized in that a change in the operating pressure by a particular value effects a smaller change in the swept volume in the presence of high operating pressures than in the presence of low operating pressures.

The main advantage of embodiments of the disclosure consists in that the piston rod can be omitted, such that the adjustment device can be realized with lower outlay in terms of apparatus and with a shorter structural length. It is possible for two feedback springs or even more than two feedback springs to be provided, wherein, in the latter case, a pressure-swept volume characteristic curve with more than one bend is possible.

The object is also achieved by means of a hydrostatic axial piston machine which has an adjustment device according to the disclosure as described above.

Embodiments of an adjustment device according to the disclosure emerge from the figures, claims and description.

In the case of an adjustment device according to the disclosure, the adjustment piston customarily has the smallest spacing to the valve slide at maximum swept volume of the piston machine, and has the greatest spacing to the valve slide at minimum swept volume of the piston machine.

The second feedback spring is preferably arranged such that, over a first partial travel, said second feedback spring acts counter to the spring force of the first feedback spring, and over a second partial travel of the adjustment piston, said second feedback spring is fully relaxed. It is conceivable here for the two feedback springs to act on the valve slide fully independently of one another. Proceeding from a position of the adjustment piston and thus proceeding from a swept volume in which or at which the characteristic curve has a bend, it is the case that, during an adjustment in the direction of a smaller swept volume, the spring force exerted on the valve slide is the difference between the decreasing spring force of the first feedback spring and the increasing force of the second feedback spring, such that the spring force acting on the valve slide sharply decreases, and the operating pressure can correspondingly sharply increase. Proceeding from said position of the adjustment piston, in the case of an adjustment in the direction of greater swept volume, the second feedback spring is fully relaxed, such that the spring force acting on the valve slide moderately increases, and the operating pressure correspondingly moderately decreases, in accordance with the spring constant of the first feedback spring.

In a further embodiment, the two feedback springs do not act on the adjustment piston independently of one another but are arranged between the adjustment piston and a spring bearing, which bears against the valve slide, such that, over the first partial travel of the adjustment piston, the first feedback spring exerts a force in one direction on the spring bearing and the second feedback spring exerts a force in the opposite direction on the spring bearing. Proceeding from a position of the adjustment piston and thus proceeding from a swept volume in which or at which the characteristic curve has a bend, it is the case that, during an adjustment in the direction of smaller swept volume, the decreasing force of the first feedback spring is further reduced by the extent of an increasing force of the second feedback spring already at the disk spring, such that the spring force acting on the valve slide sharply decreases, and the operating pressure correspondingly sharply increases.

The first feedback spring is preferably supported on the adjustment piston directly. The second feedback spring is advantageously supported on the adjustment piston via a retention part which is inserted into the adjustment piston. The retention part may be a circlip which is inserted into the adjustment piston. The retention part may also be a central projection which is inserted into the adjustment piston and which extends through the spring disk.

The spring bearing is preferably in the form of a bushing with an inner support surface for one feedback spring and with an outer support surface for the other feedback spring, wherein the support surface for the second feedback spring is further remote than the support surface for the first feedback spring from that end of the spring bearing which bears against the valve slide. In this way, at least in subsections of the adjustment piston travel, an at least partially overlapping arrangement of the two feedback springs, and thus a short construction in the axial direction of the adjustment piston, are possible.

The second feedback spring may be situated at the outside or at the inside on the spring bearing in the form of a bushing.

In another embodiment, the second feedback spring exerts its force on the valve slide additively with respect to the force of the first feedback spring, wherein, during an adjustment of the adjustment piston in the direction of maximum swept volume of the piston machine, beyond the particular position of the adjustment piston, the force exerted on the valve slide by the second feedback spring remains constant. Proceeding from a position of the adjustment piston and thus proceeding from a swept volume in which or at which the characteristic curve has a bend, it is the case during an adjustment in the direction of smaller swept volume that the spring force exerted on the valve slide is the sum between the decreasing spring force of the first feedback spring and the decreasing force of the second feedback spring, such that the spring force acting on the valve slide sharply decreases, and the operating pressure can correspondingly sharply increase. Proceeding from said position of the adjustment position, during an adjustment in the direction of greater swept volume, the force exerted on the valve slide by the second feedback spring remains constant, such that the spring force acting on the valve slide moderately increases, and the operating pressure correspondingly moderately decreases, in accordance with the spring constant of the first feedback spring.

In relation to an embodiment with subtraction of the spring force of the second feedback spring from the spring force of the first feedback spring, it is possible for the force level of the first feedback spring to be lower in the case of an embodiment in which, over a partial travel, the two spring forces are added and, subsequently, the force of the second feedback spring is kept constant.

The addition of the spring forces over a partial travel, and the fact that the spring force of the second feedback spring is subsequently kept constant, can advantageously be realized by virtue of the second feedback spring being braced between the spring bearing and a stop part, wherein a support spring is braced between the stop part and the adjustment piston, and wherein the stop part is prevented from performing a further movement beyond the particular position of the adjustment piston.

In the particular position of the adjustment piston, the stop part advantageously abuts against a housing of the regulation valve.

If the adjustment pressure in the adjustment chamber were to exert a resultant force on the valve slide, this would, even if the adjustment pressure is generally significantly lower than the operating pressure, have an adverse effect on the accuracy of the power regulation, especially since the adjustment pressure is dependent on the operating pressure, on the force, which varies with the position of the adjustment piston, of a restoring spring for the swashplate, and on other parameters. It is thus expedient for the valve slide to be force-balanced with regard to the pressure prevailing in the adjustment chamber.

A highly compact design can be realized by virtue of the fluid connections being controlled by means of an annular groove in the valve slide and by means of a fluid path, running within the valve slide, from the annular groove into the adjustment chamber.

BRIEF DESCRIPTION OF THE DRAWINGS

Embodiments of an adjustment device according to the disclosure are illustrated in the drawings. The invention will now be discussed in more detail on the basis of the figures of said drawings.

In the drawings.

DETAILED DESCRIPTION

Figure 1:
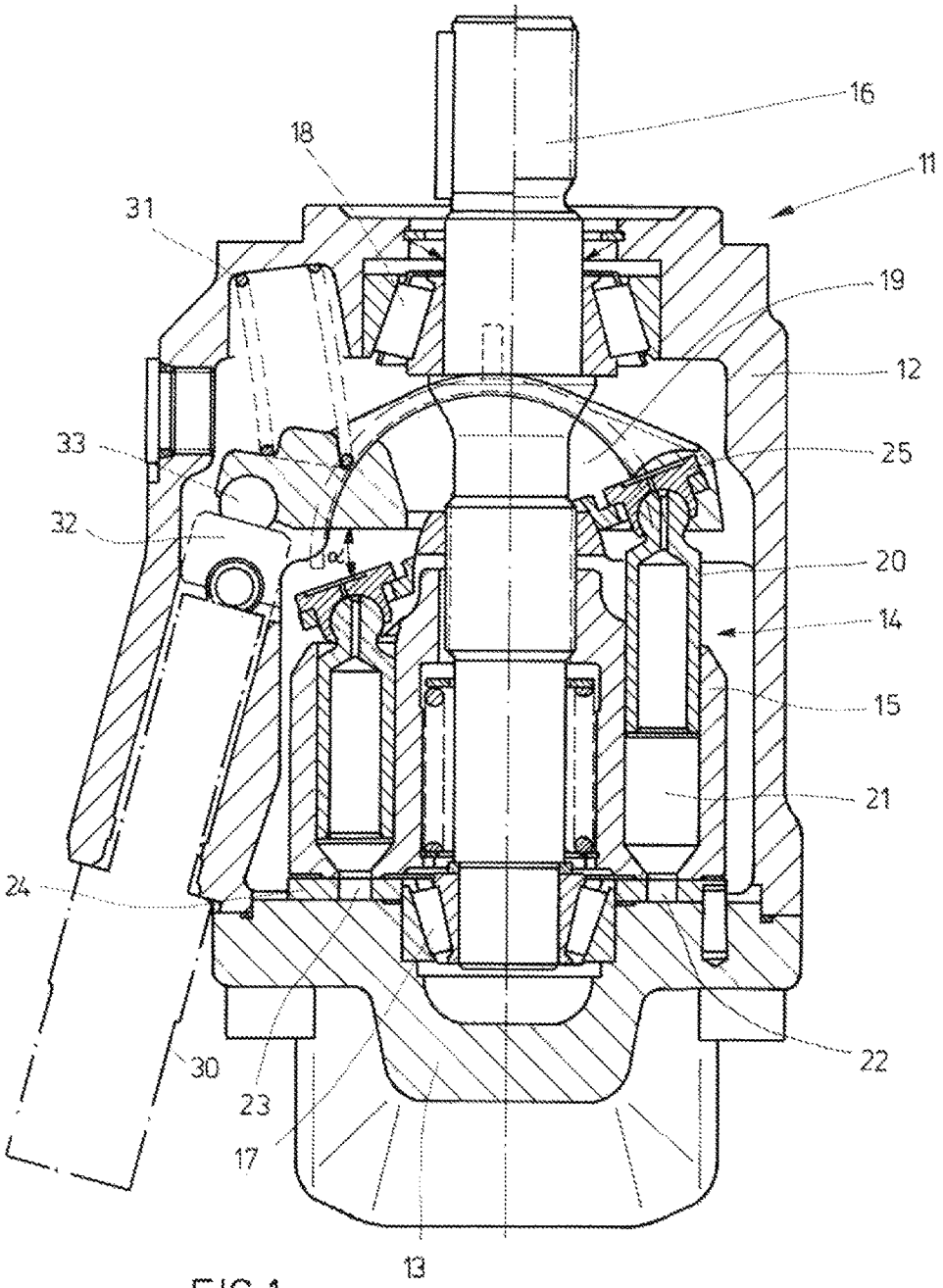
FIG. 1 shows a longitudinal section through an axial piston pump of swashplate type of construction with the external contour of an adjustment device according to the invention.

The hydrostatic axial piston machine shown in FIG. 1 is designed as an axial piston pump. It has a pump housing 11 which is composed of a pot-shaped housing main part 12 and of a port plate 13 and in which a drive unit 14 is accommodated. Said drive unit includes a cylinder drum 15, a drive shaft 16, which is mounted in the pump housing by way of two tapered-roller bearings 17 and 18 and to which the cylinder drum 15 is rotationally conjointly coupled, and a pivot cradle 19, which is adjustable in terms of its angular position in relation to the axis of the drive shaft. In the cylinder drum 15, a multiplicity of displacement pistons 20, which delimit in each case one working chamber 21, are guided parallel to the axis of the drive shaft. The supply of pressure medium to and the discharge of pressure medium out of the working chambers 21 is controlled by way of two kidney-shaped control ports 22 and 23, said kidney-shaped control ports being formed in a control plate 24 which is held rotationally fixedly with respect to the housing and having a pressure medium connection to a pressure port and a suction port in the port plate 13. The kidney-shaped control ports 22 and 23 themselves are not visible in the section in FIG. 1, because they are situated in front of and behind the plane of the drawing, but they are indicated for clarity.

The heads, facing away from the working chambers 21, of the displacement pistons 20 are supported by way of slide shoes 25 on a pivot cradle 19, the pivot angle $\alpha$ of which is, for the purposes of varying the swept volume, adjustable by way of an adjustment device 30 indicated by dash-dotted lines. In the exemplary embodiment illustrated, the pivot cradle 19 is preloaded by way of a restoring spring 31 into a basic position in which the pivot angle and thus the swept volume are at a maximum. By deployment of an adjustment piston 32, discussed in more detail below, of the adjustment device 30, the pivot cradle can be pivoted back counter to the force of the restoring spring and counter to the drive unit forces for a reduction of the pivot angle and thus of the swept volume, as far as into a position of minimum swept volume, for example as far as a swept volume of zero. FIG. 1 shows the pivot cradle in a position in which the abutment surface for the displacement pistons is perpendicular to the axis of the drive shaft, that is to say the swept volume is zero. By contrast, the displacement pistons are shown in a position of maximum swept volume. The connection of the adjustment device 30 to the pivot cradle 19 is realized, as illustrated, for example by way of a ball 33 which is inserted movably into the pivot cradle and which has a flattened portion.

Figure 2A:
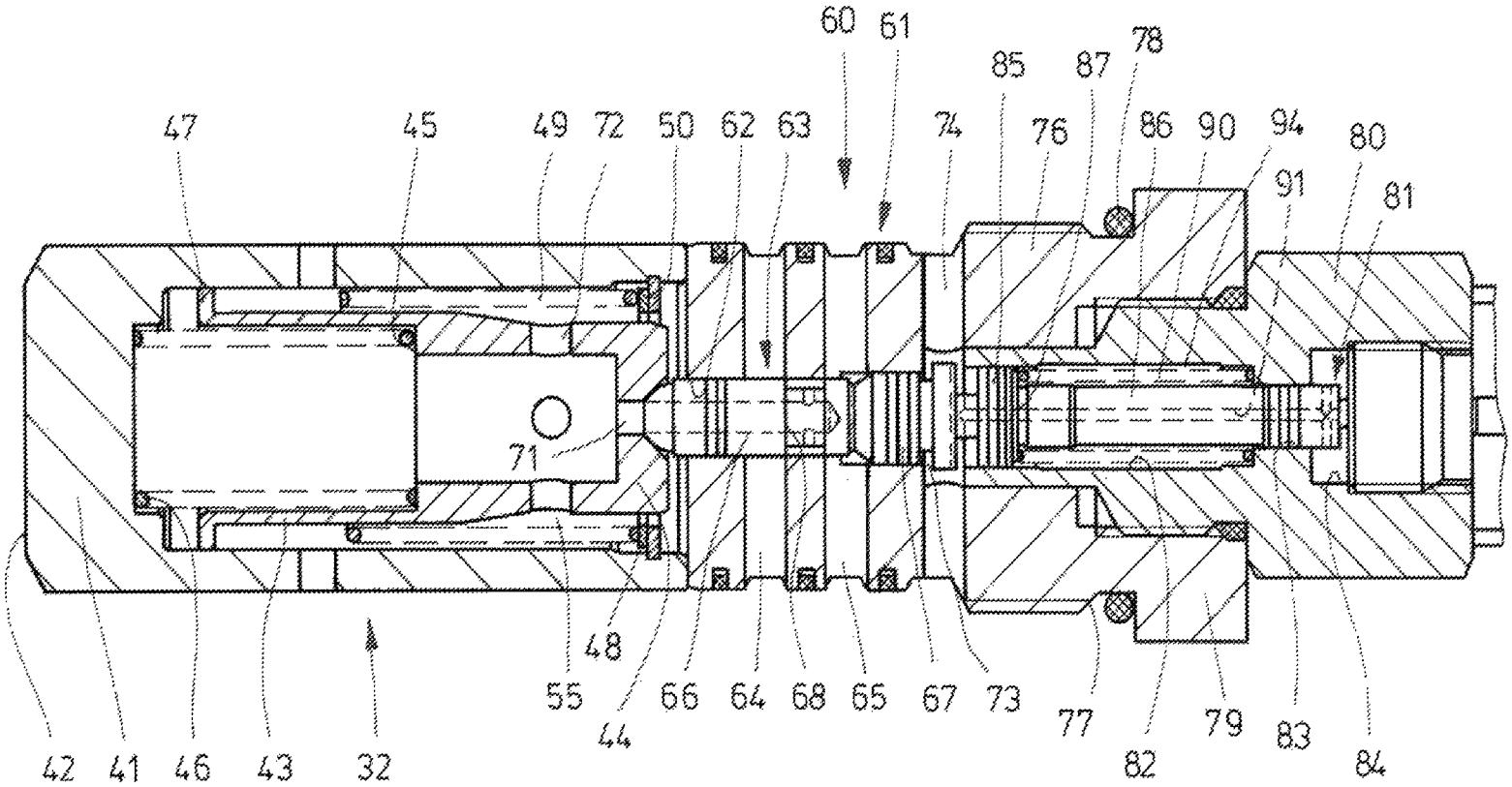
FIG. 2*a* shows a longitudinal section through a part of the first exemplary embodiment of an adjustment device according to the invention of the axial piston machine according to FIG. 1.
Figure 2B:
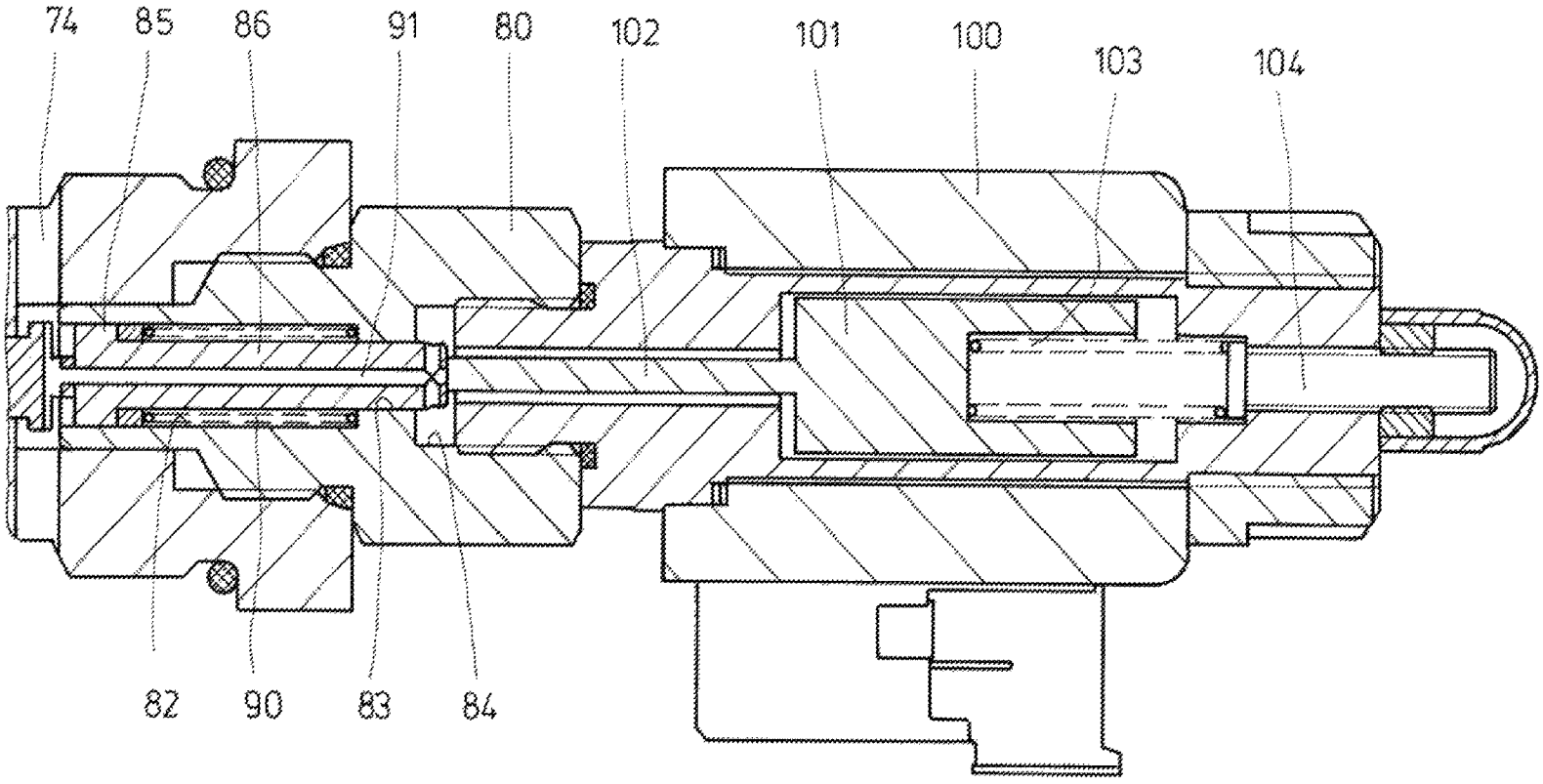
FIG. 2*b* shows a longitudinal section through another part of the first exemplary embodiment.
Figure 3:
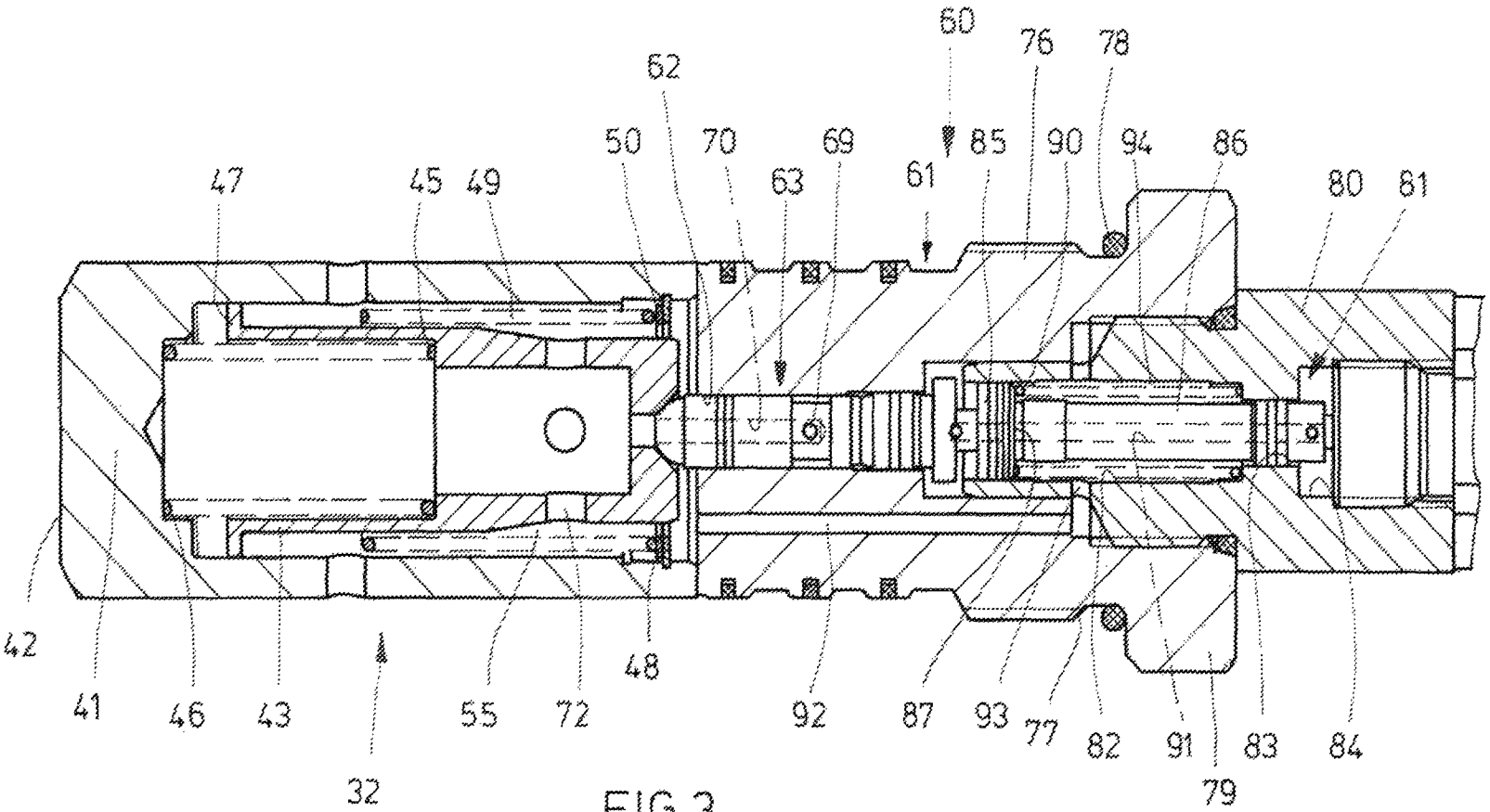
FIG. 3 shows a longitudinal section through the adjustment device from FIGS. 2*a* and 2*b* in a plane rotated through 90 degrees in relation to the section plane in FIGS. 2*a* and 2*b*.
Figure 4:
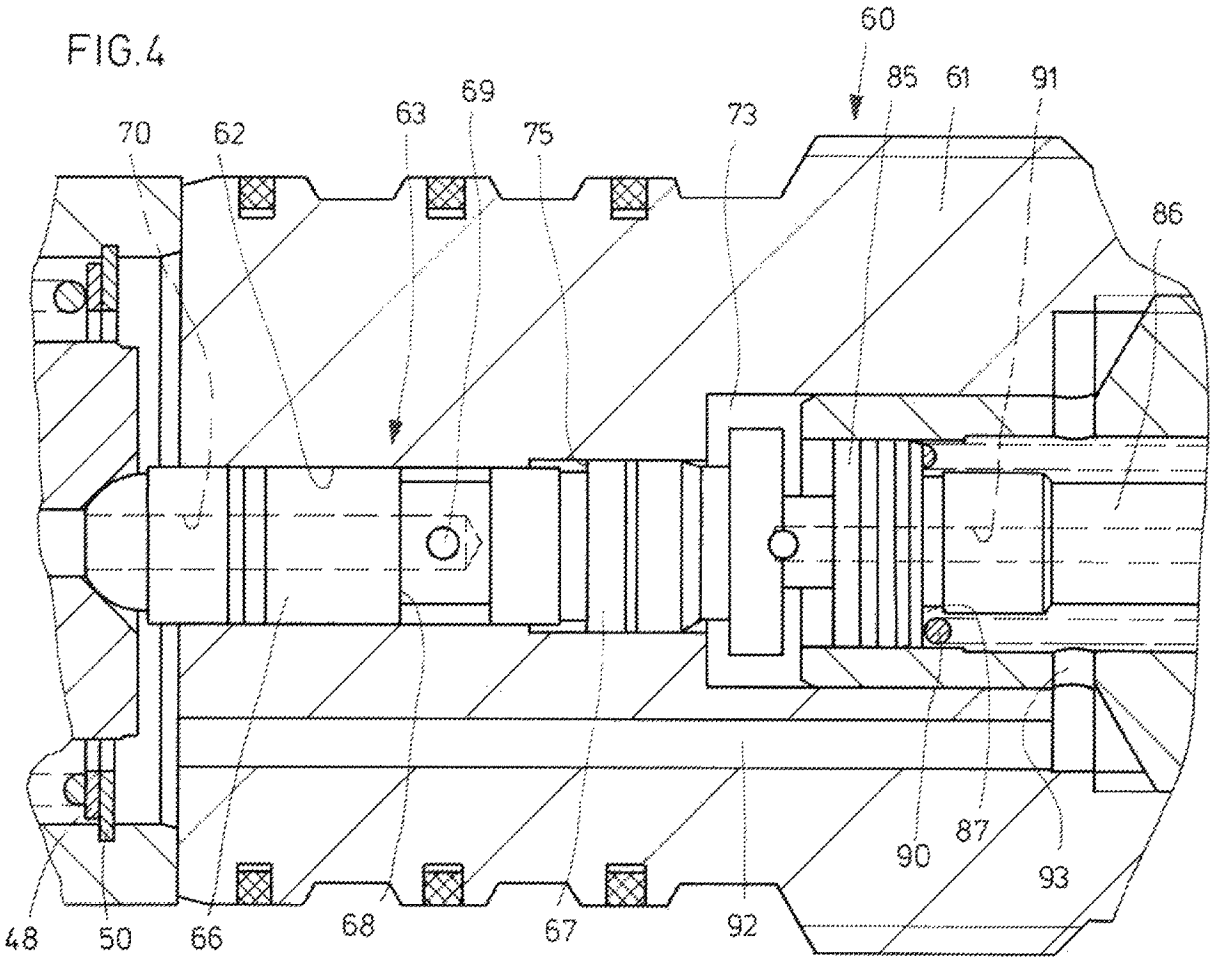
FIG. 4 is an enlarged illustration of a detail from FIG. 3.

A first adjustment device 30, which can be used for the axial piston pump from FIG. 1, is shown in FIGS. 2 to 4.

As main structural assemblies, the adjustment device 30 comprises the abovementioned adjustment piston 32 and a regulation valve 60, which are arranged in alignment one behind the other on the same central axis and are inserted into an elongate cavity of the housing main part 12. The regulation valve has a cartridge-like valve housing 61 which is screwed into the housing main part 12 and which has a valve bore 62, which valve bore runs in the direction of the central axis and in which valve bore a valve slide 63 is displaceable in the direction of the bore axis.

The adjustment piston 32 is guided in the housing main part 12 and is in the form of a bushing which is open toward the regulation valve 60 and which has a base 41 with a planar outer side 42, by way of which said adjustment piston bears against the flattened portion of the ball 33. In the interior of the adjustment piston 32 there is accommodated a bushing-like spring bearing 43 which is open toward the base 41 of the adjustment piston 32 and, by way of a base 44, faces toward the regulation valve 60, and bears by way of said base against the valve slide 63 of the regulation valve. A first feedback spring 46 in the form of a helical compression spring is braced between the base 41 of the adjustment piston 32 and an inner shoulder 45 which is situated approximately in the center of the spring bearing 43. The position of the inner shoulder 45 is dependent on the power level and the nominal size of a pump, and in other embodiments may be in a position other than that shown. The force exerted by the feedback spring 46 is always greater than zero, regardless of the position of the adjustment piston 32. At its open end, the spring bearing has an outer collar 47. This permits the abutment of a second feedback spring 49, which is in the form of a helical compression spring, against the spring bearing 43. The second feedback spring 49 is situated on the outside of the spring bearing 43, between the latter and the adjustment piston 32. Axially, said second feedback spring is arranged between the outer collar 47 on the spring bearing 43 and a circlip 50 which is inserted into the adjustment piston 32. Between the circlip and the feedback spring 49 there may be inserted one or more shims 48, or no shims, which serve for defining at what position of the adjustment piston 32 and thus of the pivot cradle 19 the second feedback spring 49 engages, and the bend in the characteristic curve is situated. Owing to the position of the inner shoulder 45 and of the outer collar 47 on the spring bearing 43, the two feedback springs 46 and 49 axially overlap, thus making it possible to realize a short construction.

By way of the outer collar 47, the spring bearing 43 is guided on the adjustment piston 32, thus giving rise to 2-point guidance for the spring bearing, with the outer collar 47 on the adjustment piston 32 and with the base 44 on the valve slide 63.

FIGS. 2 to 4 show the adjustment piston 32 in a position in which it bears against the valve housing 61 and which corresponds to a maximum swept volume of the axial piston pump. In this position of the adjustment piston 32, the clear spacing between the circlip 50 and the outer shoulder 47 is, taking into consideration the thickness of any shims 48 that may be provided, greater than the length of the fully relaxed second feedback spring 49. If, proceeding from the position shown in FIGS. 2 to 4, the adjustment piston 32 now moves away from the valve housing 61 in the direction of a smaller swept volume, initially only the feedback spring 46 is active, and the force exerted on the spring bearing 43 in the direction of the valve slide 63 decreases with travel, with a gradient corresponding to the spring constant of the feedback spring 46. Finally, the adjustment piston 32 reaches a particular position, in which the clear spacing between the circlip 50 and the outer shoulder 47 is, taking into consideration the thickness of any shims 48 that may be provided, equal to the length of the fully relaxed second feedback spring 49. During the further movement, the feedback spring 49 is then braced to an ever greater extent. Since the latter feedback spring exerts on the spring bearing 43 a force which is directed counter to the force of the feedback spring 49, it is the case that, proceeding from the particular position of the adjustment piston 32, the force exerted on the spring bearing 43 in the direction of the valve slide 43 decreases more rapidly with the travel of the adjustment piston 32 than before the particular position was overshot.

The valve bore 62 of the valve housing 61 is open toward the adjustment piston 32 and is transversely intersected, at positions axially spaced apart from one another, by a first transverse bore 64 and by a second transverse bore 65, which open out on the outside of the valve housing into annular chambers which are separated from one another and from the interior of the pump housing 11 by way of seals. The transverse bore 64 which is situated closest to that end of the valve housing 61 which faces toward the adjustment piston 32 is connectable directly, or via further regulators of the pump, to a tank. Said transverse bore thus serves as a pressure medium outflow duct. If the further regulators are active, the transverse bore 64 is connectable by way of the further regulators also to the pressure port of the pump, and then serves as a pressure medium inflow duct. The transverse bore 65 is connected to the pressure port of the pump. The latter transverse bore thus serves only as a pressure medium inflow duct.

The valve slide 63 has, between two control collars 66 and 67, an annular groove 68, the width of which is equal to the clear spacing between the two transverse bores 64 and 65. In the annular groove 68, the valve slide has, as a transverse bore, a radial bore 69 which, at the inside, intersects an axial bore 70 which is in the form of a blind bore and which is open at that face side of the valve slide 63 which faces toward the spring bearing 43 and the adjustment piston 32. The radial bore 69 has a smaller cross section than the axial bore 70. In this way, the reaction on the valve slide 63 is reduced, and thus the influence of the flow forces on the valve characteristic is reduced.

In the regulation position of the valve slide 63 shown in FIGS. 2 to 4, the two transverse bores 64 and 65 are just overlapped by the control collars 66 and 67. The regulation valve 60 is thus configured with a zero overlap. However, a slight negative overlap is also possible, wherein, then, the width of the annular groove 68 is slightly larger than the clear spacing between the two transverse bores 64 and 65. If, proceeding from the regulation position shown, the valve slide is moved to the left in the view as per FIGS. 2 to 4, a fluidic connection between the transverse bore 64 and an adjustment chamber 55 formed by the adjustment piston 32, the housing main part 12 and the valve housing 61 is produced via the annular groove 68 and the bores 69 and 70. Control oil can thus be displaced out of said adjustment chamber to the tank, such that the adjustment piston 32 moves, with a reduction in size of the volume of the adjustment chamber 55, in the direction of a larger swept volume.

If, proceeding from the regulation position shown, the valve slide is moved to the right in the view as per FIGS. 2 to 4, a fluidic connection between the transverse bore 65 and the adjustment chamber 55 is produced via the annular groove 68 and the bores 69 and 70. Control oil can then flow from the pressure port of the pump to said adjustment chamber, such that the adjustment piston 32 moves, with an increase in volume of the adjustment chamber 55, in the direction of a smaller swept volume. In order that the control oil can flow freely, the spring bearing is provided with a bore 71 in its base directly in front of the valve slide 63 and with openings 72 in its wall.

In the region of the transverse bore 65, the valve bore 62 has a step such that its diameter proceeding from the step to that end of the valve housing 61 which faces toward the adjustment piston 32 is slightly smaller than the diameter proceeding from the step in the other direction. Correspondingly to the step in the valve bore 62, the valve slide 63 has, in the control collar 67, a step in which the diameter increases from the diameter in the control collar 66 to a different diameter, such that a measurement surface 75 is formed at which the valve slide 63 is acted on by the pump pressure prevailing in the transverse bore 65. Said pump pressure generates, at the measurement surface 75, a pressure force which is oriented in the same direction as the force which is exerted on the valve slide 63 by the feedback springs 46 and 49 via the spring bearing 43.

At the other side of the transverse bore 65 as viewed from the transverse bore 64, the valve slide 63 protrudes into a widened section 73 of the valve bore 62, said widened section being connected by way of a transverse bore 74 to the interior of the pump housing. The housing pressure thus prevails in that region, which housing pressure is subject to only slight pressure fluctuations and corresponds approximately to the tank pressure. The force exerted on the valve slide 63 by said pressure is thus negligible.

Adjacent to the transverse bore 74, the valve housing 61 has a threaded section 76 which is provided, on the outside, with a thread and which is followed, after a turned recess 77 for a seal 78, by a flange 79. By way of the threaded section 76, the regulation valve 60 is screwed into the housing main part 12 until the flange 79 bears against the housing main part 12.

From the end facing away from the adjustment piston 32, there is screwed into the valve housing 61 a nipple-like auxiliary housing part 80 which, centrally, has a continuous cavity 81 with three cavity sections 82, 83 and 84 of different diameter. The middle cavity section 83 has the smallest diameter. The cavity section 82 which is adjacent in the inward direction toward the valve slide 63 has a larger diameter, wherein the diameter difference between the two stated cavity sections 82 and 83 is selected such that the difference in cross-sectional area between the two cavity sections corresponds exactly to the cross-sectional area of the valve slide 63 in the region of the control collar 66. It is by way of said cross-sectional area that the valve slide is forced to the right in the view of FIGS. 2 to 4 by the pressure prevailing in the adjustment chamber 55.

In the cavity section 82 of the auxiliary housing part 80 there is guided a compensation piston 85 which, by way of a piston rod 86, is guided with little play and in substantially sealed fashion through the cavity section 83 of the cavity 81 and projects into the cavity section 84 with the largest diameter. Owing to the piston rod 86, there is formed on the compensation piston 85, within the cavity section 82, an effective annular surface 87 which is equal to the cross-sectional area of the valve slide 63 in the region of the control collar 66. Via a longitudinal bore 91 and a transverse bore in the compensation piston 85, a transverse bore and a blind bore at that end of the valve slide 63 which faces toward the compensation piston, and the transverse bore 74 of the valve housing 61, the cavity section 84 is fluidically connected to the interior of the pump housing 11, in which approximately tank pressure prevails, such that the compensation piston 85 is relieved of pressure with regard to the guide cross section of its piston rod 86 in the cavity section 83.

The cavity section 82 of the cavity 81 accommodates not only the compensation piston 85 but also a regulation spring 90 which surrounds the piston rod 86 and is supported on a step between the two cavity sections 82 and 83 on the auxiliary housing part 80 and on the annular surface 87 of the compensation piston 85, and which forces the compensation piston 85 against the valve slide 63. The regulation spring 90 thus exerts, via the compensation piston 85, a force which is directed counter to the force generated by the pump pressure and counter to the force exerted by the feedback springs 46 and 49.

The volume, delimited by the compensation piston 85 and the auxiliary housing part 80, of the cavity section 82 is fluidically connected via an eccentrically situated longitudinal bore 92 in the valve housing 61 and via a transverse bore 93 in the auxiliary housing part 80 to the adjustment chamber 55 and thus forms a pressure chamber 94 in which the adjustment pressure prevails. The adjustment pressure acts on the compensation piston 85 at the annular surface 87, which is of the same size as the cross-sectional area of the valve slide 63 in the region of the control collar 66. The valve slide is thus acted on by the adjustment pressure at one side, at its face side facing toward the adjustment piston 32, in one direction and at the other side, via the compensation piston 85, in the opposite direction. The surfaces acted on are of equal size, such that the valve slide is force-balanced with regard to the adjustment pressure, or, to use the conventional term, pressure-balanced.

The longitudinal bore 92 extends from that face side of the valve housing 61 which faces toward the adjustment piston 32, and opens out in a step of a stepped recess of the valve housing 61 for the auxiliary housing part 80. From there, the bore 93 in the auxiliary housing part produces the connection to the pressure chamber 94. There is thus no need for an oblique or radial bore in the valve housing.

In the exemplary embodiment shown, the compensation piston 85 is, together with its piston rod 86, a stand-alone, unipartite component. The valve slide and the compensation piston may also be realized as a unipartite component. However, two separate parts make the manufacturing process easier, because alignment errors between the valve bore 62 in the valve housing 61 and the cavity section 82 in the auxiliary housing part 80 have no influence on the free movement of the valve slide 63 and of the compensation piston 85.

The cavity section 84 is equipped with an internal thread. Said cavity section can be closed off to the outside by way of a closure screw.

In the present case, however, a proportional electromagnet 100 is screwed onto the auxiliary housing part 80. The electromagnet has a magnet armature 101 with a plunger 102 which bears against the compensation piston 85, and a helical compression spring 103, which forces the magnet armature in the direction of the compensation piston 85. The helical compression spring 103 thus acts in addition to the regulation spring 90, and in the same direction as the latter, on the valve slide 63. The two springs 90 and 103 can be referred to collectively as regulation spring arrangement, said springs exerting on the valve slide a force in a direction which is directed counter to the force of the feedback springs 46 and 49 and counter to the pressure force generated by the operating pressure at the measurement surface 75 of the valve slide. The stress of the helical compression spring 103 can be varied by way of an adjustment screw 104. The adjustment screw is accessible even in the installed state of the regulation valve 60 in the pump. This permits simple tuning of the regulation valve to the pump. The adjustment of the torque is thus even possible in the field without dismounting the pump or the regulator. The two springs 90 and 103 may also be replaced with a single spring, which is then preferably arranged where the spring 103 is situated in the exemplary embodiment shown.

When the electromagnet 100 is energized, there is exerted on the magnet armature a force which is directed counter to the force of the helical compression spring 103. The force exerted by the electromagnet, including the helical compression spring 103, on the compensation piston 85 and thus on the valve slide can thus be varied during operation by varying the energization of the proportional magnet. In this way, the torque characteristic curve can be shifted. When the proportional magnet is deenergized, the regulated torque is at its greatest, because the electromagnet does not detract from the force of the helical compression spring. The proportional magnet has a falling characteristic curve because, with increasing current intensity, the force exerted via the plunger 102 on the compensation piston 85, and via the latter on the valve slide 63, decreases.

The use of a proportional electromagnet with a rising characteristic curve is also conceivable if the torque characteristic curve is to be shifted toward higher values with increasing current flowing through the electromagnet.

Since the housing pressure prevails in the cavity section 84 of the auxiliary housing part 80 and thus also in the proportional magnet 100, the proportional magnet does not need to be resistant to high pressure.

Instead of an electromagnet, it is also possible for there to be connected to the auxiliary housing part 80 a hydraulic control line via which the cavity section 84 can be connected to a control pressure source. Then, use is made of a compensation piston 85 without a longitudinal bore, such that the cavity section 84 is fluidically separated from the interior of the pump housing 11. A control pressure input into the cavity section 84 acts on the piston rod 86 of the compensation piston 85, such that, depending on the magnitude of the control pressure in addition to the force of the regulation spring 90, a different level of additional force acts on the valve slide 63, and the torque characteristic curve can be shifted.

The auxiliary housing part 80 is thus a universal interface for differently modified adjustment devices according to the invention.

FIGS. 2 to 4 show the adjustment device in a state in which the pivot cradle 19 of the axial piston pump from FIG. 1 has been pivoted to a maximum extent, and thus the swept volume is at a maximum. The first feedback spring 46 is braced to a maximum extent, and the second feedback spring 49 is inactive. The sum of the force of the feedback spring 46 and of the pressure force generated by the operating pressure at the measurement surface 75 of the valve slide 63 is lower than the force of the regulation spring 90. The variant of the adjustment device here is one in which the auxiliary housing part 80 is closed off by way of a closure screw and, aside from the force of the regulation spring, no additional force acts on the valve slide 63. The valve slide 63 is situated in a position in which it connects the adjustment chamber 55 to the transverse bore 64 and thus to the tank. However, the figures show the valve slide in the regulation position, in which it closes off the transverse bores 64 and 65 with slight positive or negative overlap.

The operating pressure may now rise to such an extent that the pressure force generated by the operating pressure at the measurement surface 75 plus the force of the feedback spring 46 becomes greater than the force of the regulation spring 90. The valve slide 63 is then displaced so as to connect the transverse bore 65 to the adjustment chamber 55, such that pressure medium flows into the adjustment chamber and the adjustment piston 32 moves away from the valve housing 61, while the spring bearing 43 remains in contact with the valve slide 63. As a result, the force of the feedback spring 46 becomes lower. When the sum of the lower force of the feedback spring 46 and the greater pressure force assumes a value equal to the force of the regulation spring 90, the valve slide 63 moves into its regulation position, in which it separates the adjustment chamber 55 from the transverse bores 64 and 65, aside from small regulation movements. A further increase in operating pressure leads again to a displacement of the valve slide, such that further pressure medium flows into the adjustment chamber 55 and the adjustment piston 32 moves further away from the valve housing 61, with a reduction in the force of the feedback spring 46, into a position in which the forces acting on the valve slide 63 are in equilibrium. If the operating pressure becomes lower, the valve slide is displaced out of the regulation position in the opposite direction, and connects the adjustment chamber 55 to the transverse bore 64, such that pressure medium flows out of the adjustment chamber. The adjustment piston 32 moves toward the valve housing, and the force of the feedback spring 46 increases until the decrease in pressure force is compensated.

The gradient of a curve representing the dependency between the travel of the adjustment piston 32 and the operating pressure is initially defined exclusively by the spring constant of the feedback spring 46.

During the further movement away from the valve housing 61, the adjustment piston 32 finally passes into a position in which the spacing between the outer collar 47 on the spring bearing 43 and the circlip 50 (including shims) corresponds to the length of the relaxed feedback spring 49. During the further movement of the adjustment piston 32, the feedback spring 49 then also becomes active. Then, the force exerted on the valve slide 63 via the spring bearing 43 decreases to a greater extent over a particular travel than before the feedback spring 49 became active, because not only does the force exerted on the spring bearing by the feedback spring 46 become lower, but the force of the feedback spring 49 acting in the opposite direction becomes greater. Correspondingly, the characteristic curve between the travel of the adjustment piston 32 and the operating pressure becomes steeper. Said characteristic curve is thus made up of two straight sections of different gradient, which intersect at a position of the adjustment piston 32 in which the feedback spring 49 becomes active and inactive.

If universality of the auxiliary housing part 80 and a displacement of the torque characteristic curve are not desired, then the cavity 81 does not need to be continuous, and instead may be a blind bore with two different diameters, wherein the chamber between the free face side of the piston rod and the base of the blind bore is fluidically connected to the transverse bore 74.

Figure 5:
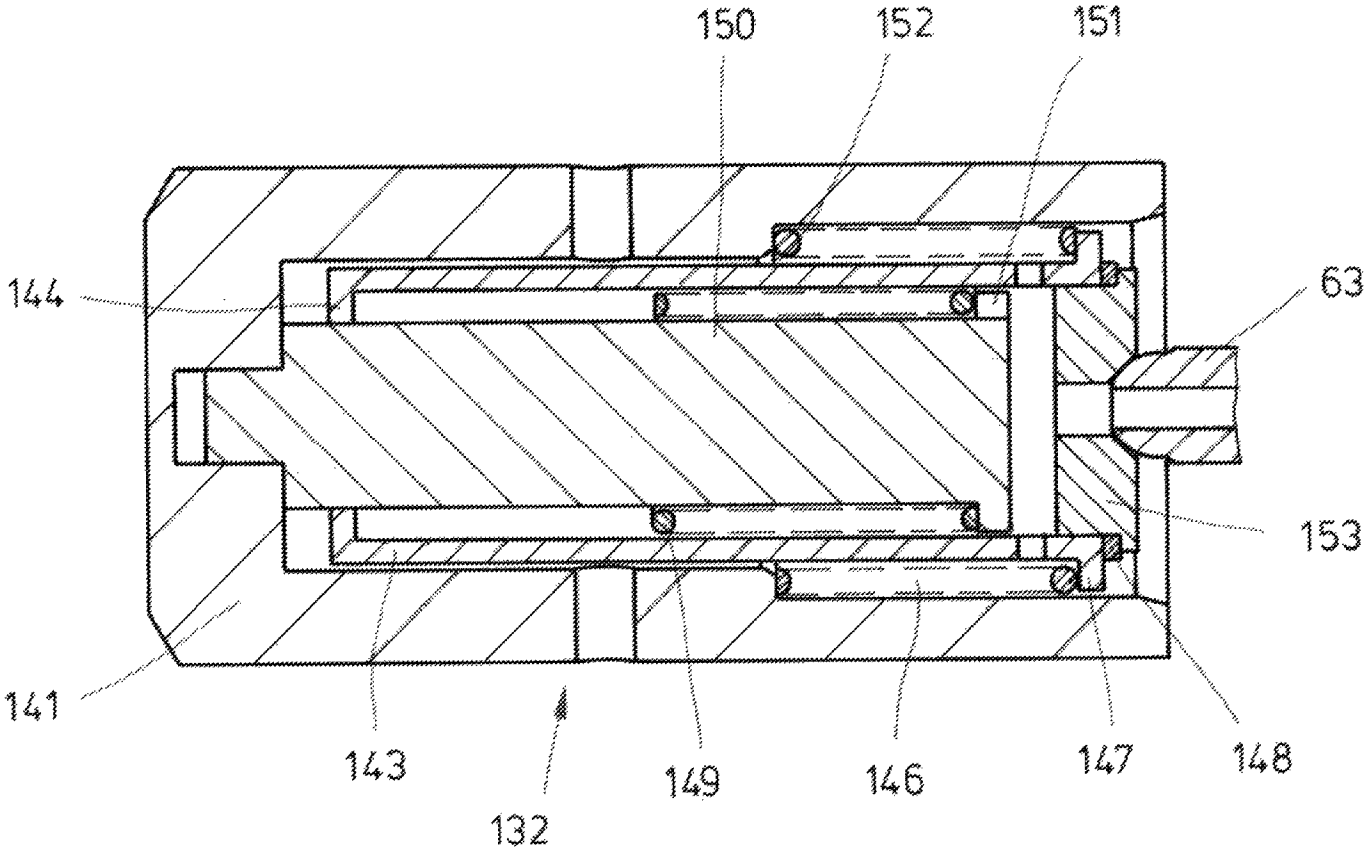
FIG. 5 shows a longitudinal section through a second exemplary embodiment of an adjustment device according to the invention in the region of the feedback springs.

FIG. 5 shows an assembly composed of an adjustment piston 132, feedback springs 146 and 149 and spring bearing 143, which duly differs from the corresponding assembly from FIGS. 2 to 4 but can be used together with the regulation valve 60 as per FIGS. 2 to 4. Similarly to the spring bearing 43, the spring bearing 143 is of bushing-like form with a base 144 and with an outer collar 147, but without an inner shoulder. Said spring bearing 143 is inserted, rotated through 180 degrees in relation to the spring bearing 43 from FIGS. 2 to 4, into the bushing-like adjustment piston 132, such that the base 144 of said spring bearing is situated in the vicinity of the base 141, and the outer shoulder 147 is situated in the vicinity of the open end of the adjustment piston 132. In the base 144 of the spring bearing 143 there is situated an aperture through which there extends a projection 150 which is pressed into, or connected in non-positively locking fashion in some other way to, the base 141 of the adjustment piston 132 and which, at its free end situated within the spring bearing 143, is equipped with an outer collar 151.

Between the projection 150 and the spring bearing 143, there is now arranged a second feedback spring 149. The latter may be braced axially between the outer collar 151 of the projection 150 and the base 141 of the spring bearing 143. A first feedback spring 146 is braced axially between the outer collar 147 of the spring bearing 143 and an inner shoulder 152 of the adjustment piston 132. In the direction of the valve slide 63, there is placed into the spring bearing 143 a disk 153, via which the valve slide 63 bears against the spring bearing. Between the disk 153 and the spring bearing 143 there may be inserted shims 148 for defining that position of the adjustment piston 132 in which the second feedback spring 149 becomes active and inactive. The force of the feedback spring 149, which is dependent on the overall thickness of the shims, can be compensated by adjustment of the opposing force on the other side of the valve slide. Similarly to the exemplary embodiment as per FIGS. 2 to 4, bores and cutouts are provided in the disk 153, in the spring bearing 143 and in the projection 150 in order to permit a free flow of pressure medium between all parts of the adjustment chamber and the valve slide.

In both exemplary embodiments as per FIGS. 2 to 5, it is a particular advantage that the assembly composed of the adjustment piston, the spring bearing and the feedback springs can be handled independently and inserted separately from the regulation valve into the pump housing. This is because the adjustment piston and spring bearing are held captively on one another, as the second feedback spring 49 or 149 prevents the spring bearing from being pushed away from the adjustment piston by the first feedback spring 46.

Likewise, the valve slide is captively held in the valve housing, such that the regulation valve, too, can be handled and easily installed as a valve assembly. The valve assembly may in this case be virtually identical over all nominal sizes and power stages. Only the diameter of the valve slide, and correspondingly the diameter of the valve bore, need to be adapted, if necessary, to different adjustment chamber sizes. In the adjustment piston assembly, the variance with regard to nominal sizes and different power stages is manifested in the form of different feedback spring packs.

Figure 6:
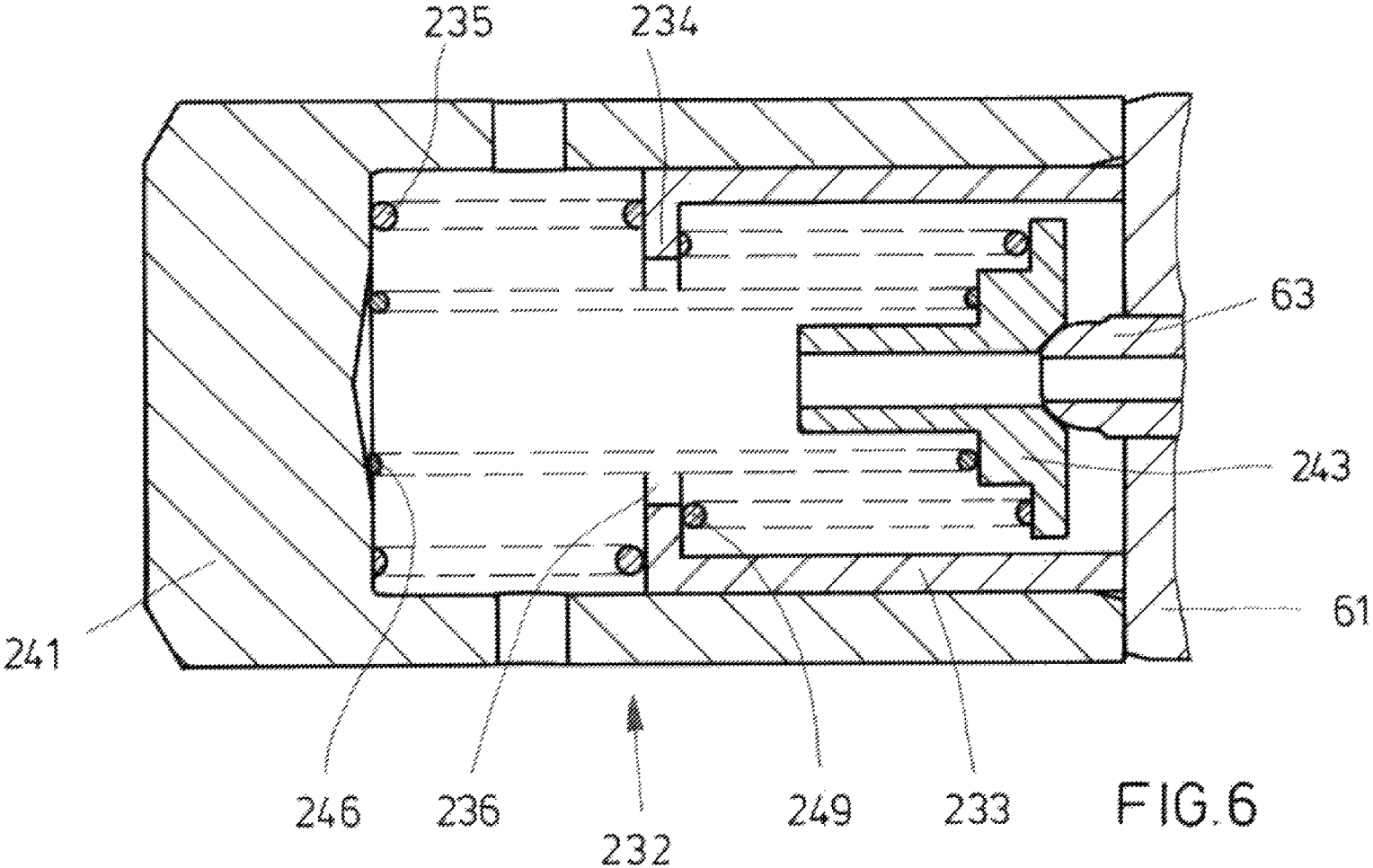
FIG. 6 shows a longitudinal section through a third exemplary embodiment of an adjustment device according to the invention in the region of the feedback springs.

FIG. 6 shows an assembly composed of an adjustment piston 232, feedback springs 246 and 249 and spring bearing 243, which assembly can likewise be used together with the regulation valve 60 as per FIGS. 2 to 4. By contrast to the two exemplary embodiments as per FIGS. 2 to 5, in the exemplary embodiment as per FIG. 6, regardless of the position of the adjustment piston 232, it is always the case that both feedback springs act on the spring bearing 243 which bears against the valve slide 63, which spring bearing is now formed substantially as a spring disk with a guide peg for the feedback springs. The forces exerted by the feedback springs on the spring bearing are oriented in the same direction, and add up to give an overall force greater than each individual force.

A stop bushing 233 is guided movably in the hollow adjustment piston 232. The second feedback spring 249 is braced between the base 234 of the stop bushing 233 and the spring bearing 243, which bears permanently against the valve slide 63. A support spring 235 is braced between the base 234 of the stop bushing 233 and the base 241 of the adjustment piston 232. In the base 234 of the stop bushing 233 there is situated a passage 236 through which the first feedback spring 246 is braced between the base of the adjustment piston 232 and the spring bearing.

FIG. 6 shows the assembly in a state in which the adjustment piston 232 is bearing against the valve housing 61 and the swept volume of the pump is at a maximum. The stop bushing 233 is also bearing against the valve housing 61. Here, the force of the support spring 235 is greater than the force of the second feedback spring 249. If, owing to a force imbalance at the valve slide 63, pressure medium now flows into the adjustment chamber 55 at the adjustment piston 232, the adjustment piston 232 moves away from the valve housing, with a reduction of the force exerted by the feedback spring 246. The force of the support spring 235 also decreases, but is initially still greater than the force of the feedback spring 249, such that the stop bushing 233 remains against the valve housing 61 and the force of the feedback spring 249 does not change. Only in a particular position of the adjustment piston 232 does the force of the support spring 235 become equal to the force of the feedback spring 249, such that during the further movement of the adjustment piston 232, the stop bushing 233 also moves. However, the travel of the stop bushing 233 is not equal to the travel of the adjustment piston 232, but is dependent on the spring constants of the two springs 235 and 249. In any case, it is now the case that the overall force of the two feedback springs 246 and 249 decreases more sharply in relation to the decrease of the force of the feedback spring 246 before the particular position of the adjustment piston 232. The travel of the adjustment piston 232 in the event of a particular change in operating pressure is now correspondingly smaller. Again, a characteristic curve composed of two intersecting straight lines of different gradient is attained, wherein the point of intersection lies where the force of the feedback spring 249 ceases to change and begins to remain constant.

In many cases, torque regulation of a pump is combined with pressure regulation or with delivery flow regulation or with both further regulation types, and a regulation valve for the pressure regulation and a regulation valve for the delivery flow regulation are provided in addition to a regulation valve for the torque regulation. In these cases, the pressure medium inflow and the pressure medium outflow into and out of the adjustment chamber 55 take place via the transverse bore 64 and the valve slide 63, which has been displaced out of the regulation position in the direction of the adjustment chamber 55. In order that, in particular, a pressure medium inflow, controlled by the delivery flow regulation valve, into the adjustment chamber 55 is possible even in the regulation position of the torque regulation valve 60, the valve slide 63 may have a bevel in the region of the control collar 66.

LIST OF REFERENCE NUMERALS

11 Pump housing
12 Housing main part
13 Port plate
14 Drive unit
15 Cylinder drum
16 Drive shaft
17 Tapered-roller bearing
18 Tapered-roller bearing
19 Pivot cradle
20 Displacement piston
21 Working chamber
22 Kidney-shaped control port
23 Kidney-shaped control port
24 Control plate
25 Slide shoe
30 Adjustment device
31 Restoring spring
32 Adjustment piston
33 Ball
41 Base of 32
42 Outer side of 41
43 Spring bearing
44 Base of 43
45 Inner shoulder of 43
46 Feedback spring
47 Outer collar of 43
48 Shim
49 Feedback spring
50 Circlip
55 Adjustment chamber
60 Regulation valve
61 Valve housing
62 Valve bore
63 Valve slide
64 First transverse bore
65 Second transverse bore
66 Control collar on 63
67 Control collar on 63
68 Annular groove on 63
69 Radial bore in 63
70 Axial bore in 63
71 Bore in 43
72 Opening in 43
73 Section of 62
74 Transverse bore in 61
75 Measurement surface on 63
80 Auxiliary housing part
81 Cavity
82 Cavity section
83 Cavity section
84 Cavity section
85 Compensation piston
86 Piston rod of 85
87 Annular surface on 85
90 Regulation spring
91 Longitudinal bore
92 Longitudinal bore
93 Transverse bore
94 Pressure chamber
100 Proportional electromagnet
101 Magnet armature
102 Plunger
103 Helical compression spring
104 Adjustment screw
132 Adjustment piston

141 Base of 132
143 Spring bearing
144 Base of 143
146 Feedback spring
147 Outer shoulder on 143
148 Shim
149 Feedback spring
150 Projection of 132
151 Outer collar on 150
152 Inner shoulder on 132
153 Disk
232 Adjustment piston
233 Stop bushing
234 Base of 233
235 Support spring
236 Passage in 233
241 Base of 232
243 Spring bearing
246 Feedback spring
249 Feedback spring

What is claimed is:

1. An adjustment device for regulating torque of a hydrostatic piston machine with an adjustable swept volume, comprising:

an adjustment piston delimiting an adjustment chamber;

a regulation valve defining a valve bore and including a valve slide positioned in the valve bore, the valve slide configured to control inflow of a pressure medium into the adjustment chamber and outflow of the pressure medium out of the adjustment chamber, the valve slide defining a measurement surface configured to be acted on by an operating pressure of the pressure medium of the piston machine in a first displacement direction;

a spring bearing at least partially located in the adjustment chamber and configured to bear against the valve slide;

a first feedback spring located within the adjustment chamber and configured to bear against the spring bearing and the adjustment piston;

a second feedback spring located within the adjustment chamber; and a regulation spring configured to exert a force on the valve slide in a second displacement direction opposite to the first displacement direction, wherein during an adjustment of the adjustment piston in a direction of minimum swept volume of the piston machine, beyond a particular position of the adjustment piston, the first feedback spring exerts a first feedback force on the valve slide and the second feedback spring is positioned in contact with the adjustment piston and the spring bearing to exert a second feedback force on the valve slide, and wherein during an adjustment of the adjustment piston in a direction of maximum swept volume of the piston machine, beyond the particular position of the adjustment piston, the first feedback spring exerts the first feedback force on the valve slide and the second feedback spring is spaced apart from at least one of the adjustment piston and the valve slide to prevent the second feedback spring from exerting the second feedback force, wherein the first feedback force is in the first displacement direction and the second feedback force is in the second displacement direction, and wherein the direction of minimum swept volume of the piston machine is opposite of the direction of maximum swept volume of the piston machine.

2. The adjustment device according to claim 1, wherein a spacing is defined between the adjustment piston and the valve slide, the spacing being smallest when the adjustment piston is at a position corresponding to the maximum swept volume of the piston machine, and the spacing being greatest when the adjustment piston is at a position corresponding to the minimum swept volume of the piston machine.

3. The adjustment device according to claim 1, wherein the second feedback spring is positioned such that, over a first partial travel of the adjustment piston, the second feedback spring exerts the second feedback force counter to the first feedback force of the first feedback spring, and over a second partial travel of the adjustment piston, the second feedback spring is fully relaxed and is prevented from exerting the second feedback force.

4. The adjustment device according to claim 3, wherein the first feedback spring and the second feedback spring are positioned between the adjustment piston and the spring bearing such that over the first partial travel of the adjustment piston, the first feedback spring exerts the first feedback force in the first displacement direction on the spring bearing and the second feedback spring exerts the second feedback force in the second displacement direction on the spring bearing.

5. The adjustment device according to claim 4, further comprising:

a retention part positioned in the adjustment piston, wherein the first feedback spring is supported on the adjustment piston directly and the second feedback spring is supported on the adjustment piston via the retention part.

6. The adjustment device according to claim 5, wherein the retention part is a circlip positioned in the adjustment piston.

7. The adjustment device according to claim 5, wherein the retention part is a central projection located in the adjustment piston and extending through the spring bearing.

8. The adjustment device according to claim 1, wherein:

the spring bearing is a bushing with an inner support surface positioned in engagement with the first feedback spring and an outer support surface positioned in engagement with the second feedback spring; and a distance defined between the outer support surface and an end of the spring bearing that bears against the valve slide is greater than a distance defined between the inner support surface and the end of the spring bearing that bears against the valve slide.

9. The adjustment device according to claim 8, wherein the second feedback spring is positioned outside of the bushing.

10. The adjustment device according to claim 8, wherein the second feedback spring is positioned inside of the bushing.

11. The adjustment device according claim 1, wherein:

the second feedback force exerted on the valve slide by the second feedback spring is additive to the first feedback force exerted on the valve slide by the first feedback spring; and the second feedback force exerted on the valve slide by the second feedback spring remains constant during the adjustment of the position of the adjustment piston in the direction towards the position of the adjustment piston corresponding to the maximum swept volume of the piston machine beyond the particular position of the adjustment piston.

12. The adjustment device according to claim 11, further comprising:

a stop part; and a support spring, wherein the second feedback spring is braced between the spring bearing and the stop part;

wherein the support spring is braced between the stop part and the adjustment piston; and wherein the stop part is prevented from further movement beyond another particular position of the adjustment piston.

13. The adjustment device according to claim 12, wherein, in the another particular position of the adjustment piston, the stop part abuts against a housing of the regulation valve.

14. The adjustment device according to claim 1, further comprising:

a compensation surface, wherein the valve bore is open toward the adjustment chamber such that the valve slide, at a face side facing toward the adjustment chamber, is loaded in the first displacement direction by an adjustment pressure;

wherein the compensation surface is at least as large as the face side facing toward the adjustment chamber that is loaded by the adjustment pressure in the first displacement direction; and wherein the adjustment pressure generates a force acting on the valve slide in the second displacement direction.

15. The adjustment device according to claim 1, further comprising:

a pressure medium inflow duct, wherein the valve slide has an annular groove via which, as a result of displacement of the valve slide from a regulation position in a first direction, a first fluidic connection is formed between the adjustment chamber and the pressure medium inflow duct, and as a result of displacement of the valve slide from the regulation position in an opposite direction, a second fluidic connection is formed between the adjustment chamber and a pressure medium outflow duct.

16. An-adjustment device for regulating torque of a hydrostatic piston machine with an adjustable swept volume, comprising:

an adjustment piston delimiting an adjustment chamber;

a regulation valve defining a valve bore and including a valve slide positioned in the valve bore, the valve slide configured to control inflow of a pressure medium into the adjustment chamber and outflow of the pressure medium out of the adjustment chamber, the valve slide defining a measurement surface configured to be acted on by an operating pressure of the pressure medium of the piston machine in a first displacement direction;

a first feedback spring and a second feedback spring located in the adjustment chamber, at least one of the first feedback spring and the second feedback spring exerts a feedback force on the valve slide depending a position of the adjustment piston;

a regulation spring configured to exert a force on the valve slide in a second displacement direction opposite to the first displacement direction;

a pressure medium inflow duct;

an axial bore which opens out at a face side of the valve slide, wherein during an adjustment of the adjustment piston in a direction of maximum swept volume of the piston machine, beyond a particular position of the adjustment piston, only the first feedback spring exerts the feedback force on the valve slide, wherein the valve slide has an annular groove via which, as a result of displacement of the valve slide from a regulation position in a first direction, a first fluidic connection is formed between the adjustment chamber and the pressure medium inflow duct, and as a result of displacement of the valve slide from the regulation position in an opposite direction, a second fluidic connection is formed between the adjustment chamber and a pressure medium outflow duct, a transverse bore which opens out in the annular groove; and wherein the transverse bore and the axial bore are in a fluidic connection between the annular groove of the valve slide and the adjustment chamber.

17. The adjustment device according to claim 16, wherein a cross section of the transverse bore is smaller than a cross section of the axial bore.

18. A hydrostatic axial piston machine, comprising:

a housing;

a drive unit including a cylinder drum, a drive shaft, and a pivot cradle, the drive unit positioned in the housing;

a plurality of displacement pistons positioned in the cylinder drum; and an adjustment device configured to regulate torque of the piston machine with an adjustable swept volume, including:

an adjustment piston delimiting an adjustment chamber;

a regulation valve defining a valve bore and including a valve slide positioned in the valve bore, the valve slide configured to control inflow of a pressure medium into the adjustment chamber and outflow of the pressure medium out of the adjustment chamber, the valve slide defining a measurement surface configured to be acted on by an operating pressure of the pressure medium of the piston machine in a first displacement direction;

a spring bearing at least partially located in the adjustment chamber and configured to bear against the valve slide;

a first feedback spring located within the adjustment chamber and configured to bear against the spring bearing and the adjustment piston;

a second feedback spring located within the adjustment chamber; and a regulation spring configured to exert a force on the valve slide in a second displacement direction opposite to the first displacement direction, wherein during an adjustment of the adjustment piston in a direction of minimum swept volume of the piston machine, beyond a particular position of the adjustment piston, the first feedback spring exerts a first feedback force on the valve slide and the second feedback spring is positioned in contact with the adjustment piston and the spring bearing to exert a second feedback force on the valve slide, wherein during an adjustment of the adjustment piston in a direction of maximum swept volume of the piston machine, beyond the particular position of the adjustment piston, the first feedback spring exerts the first feedback force on the valve slide and the second feedback spring is spaced apart from at least one of the adjustment piston and the valve slide to prevent the second feedback spring from exerting the second feedback force, wherein the first feedback force is in the first displacement direction and the second feedback force is in the second displacement direction, and wherein the direction of minimum swept volume of the piston machine is opposite of the direction of maximum swept volume of the piston machine.

* * * * *